US006675786B2

(12) United States Patent
Tsunenaga et al.

(10) Patent No.: US 6,675,786 B2
(45) Date of Patent: Jan. 13, 2004

(54) IGNITION COIL ASSEMBLY FOR ENGINE

(75) Inventors: Koji Tsunenaga, Chiryu (JP); Atsuyuki Konishi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/458,655

(22) Filed: Jun. 11, 2003

(65) Prior Publication Data

US 2003/0230294 A1 Dec. 18, 2003

(30) Foreign Application Priority Data

Jun. 12, 2002 (JP) ..... 2002-171281

(51) Int. Cl.[7] ..... F02P 1/00
(52) U.S. Cl. ..... 123/635; 123/634
(58) Field of Search ..... 123/635, 634, 123/647, 594; 336/199

(56) References Cited

U.S. PATENT DOCUMENTS 5,109,828 A * 5/1992 Tagami et al. ..... 123/635
5,152,274 A * 10/1992 Maekawa ..... 123/635
6,543,430 B2 * 4/2003 Moga et al. ..... 123/634

FOREIGN PATENT DOCUMENTS

JP 9-250437 9/1997

* cited by examiner

*Primary Examiner*—Bibhu Mohanty
(74) *Attorney, Agent, or Firm*—Nixon & Vanderhye P.C.

(57) ABSTRACT

In an ignition coil assembly, a plurality of ignition coils is arranged to be electrically connected to spark plugs received in plug holes of an engine. A base cover supports the ignition coils at corresponding positions, which correspond to positions of the plug holes, respectively. A top cover covers a top surface of the base cover. Connecting bolts connects between the top cover and the base cover. Fastening bolts secures only the base cover to the engine.

11 Claims, 13 Drawing Sheets

IGNITION COIL ASSEMBLY FOR ENGINE

CROSS REFERENCE TO RELATED APPLICATION

This application is based on and incorporates herein by reference Japanese Patent Application No. 2002-171281 filed on Jun. 12, 2002.

BACKGROUND OF THE INVENTION

1. Field of the Invention

The present invention generally relates to an ignition coil device for an engine of, for example, an automobile and more specifically to an ignition coil assembly that includes a plurality of ignition coils, which are connected to corresponding spark plugs securely installed in plug holes of the engine.

2. Description of Related Art

For example, Japanese Unexamined Patent Publication No. 9-250437 discloses an integrated connector block, in which connectors for supplying electricity to corresponding ignition coils are integrated. The integrated connector block includes a connector block main body, which is formed as an elongated body made of a resin material. Coil connectors are integrally formed in a lower surface of the connector block main body. Each ignition coil, which is secured to a corresponding spark plug installed in an engine, is installed to and is thus engaged with a corresponding one of the coil connectors in an axial direction of the corresponding ignition coil, i.e., in an axial direction of the corresponding spark plug.

Furthermore, in order to allow installation of the ignition coils to the plug holes of the engine in a single step, an ignition coil assembly, which includes a plurality of ignition coils arranged at predetermined intervals, has been proposed. For example, as shown in FIG. 12, one such ignition coil assembly 51 includes a base cover 53 and a top cover 54. The base cover 53 is made of a resin material and has a plurality of receiving through holes 53*a*, each of which receives a main body 52*b* of a corresponding one of a plurality of ignition coils 52. The ignition coils 52 are arranged at corresponding positions, which correspond to positions of plug holes 131 of an engine 130. The top cover 54 is connected to the base cover 53 in such a manner that the top cover 54 covers a top surface of the base cover 53. The top cover 54 includes a plurality of protrusions 54*a*. Each protrusion 54*a* presses a head 52*a* of the corresponding ignition coil 52. The ignition coil assembly 51 is installed to a top surface of the engine 130 in such a manner that each ignition coil 52 is axially installed into a corresponding one of the plug holes 131, and fastening bolts 55 are inserted through corresponding through holes 53*d*, 54*d* of the base and top covers 53, 54, which are provided at longitudinal ends and the center of the base and top covers 53, 54. Then, the fastening bolts 55 are threadably engaged with corresponding threaded screw holes 133 of the engine 130. In this way, the ignition coil assembly 51 is secured to the engine 130.

However, in the case of the previously proposed ignition coil assembly 51, when one or some of the ignition coils 52 need to be replaced after the installation of the ignition coil assembly 51 into the engine 130, it requires tedious and time consuming reinstallation operation of the ignition coil assembly 51 after replacement of the ignition coils 52. That is, in the ignition coil assembly 51, the base cover 53 and the top cover 54 are integrally secured to the engine 130 by the fastening bolts 55. Thus, when the fastening bolts 55 are removed, both the top cover 54 and the base cover 53 are released from the engine 130, and thus the base cover 53 tends to be misaligned relative to the engine 130 (see positional deviation of the base cover 53 in FIG. 13). At the time of reinstallation of the ignition coil assembly 51 into the engine 130, the receiving through holes 53*a* of the base cover 53 need to be aligned with the plug holes 131 once again, requiring extra time for the reinstallation.

SUMMARY OF THE INVENTION

The present invention addresses the above disadvantage. Thus, it is an objective of the present invention to provide an ignition coil assembly, which allows removable of only a top part of the assembly to facilitate replacement of one or more ignition coils.

To achieve the objective of the present invention, there is provided an ignition coil assembly for an engine. The engine includes a plurality of plug holes, each of which receives a corresponding one of a plurality of spark plugs. The ignition coil assembly includes a plurality of ignition coils, a base cover, a top cover, a connecting member and a fastening member. The ignition coils are arranged to be electrically connected to the spark plugs, respectively. The base cover supports the ignition coils at corresponding positions, which correspond to positions of the plug holes, respectively. The top cover covers a top surface of the base cover. The connecting member connects between the top cover and the base cover. The fastening member secures only the base cover to the engine.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

(First Embodiment)

An ignition coil assembly 1 according to a first embodiment of the present invention will be described with reference to FIGS. 1 to 5.

The ignition coil assembly 1 is for an automobile engine and includes a plurality of ignition coils 2, which are arranged at predetermined intervals and are axially connected to corresponding spark plugs securely received in plug holes of the engine.

Figure 1:
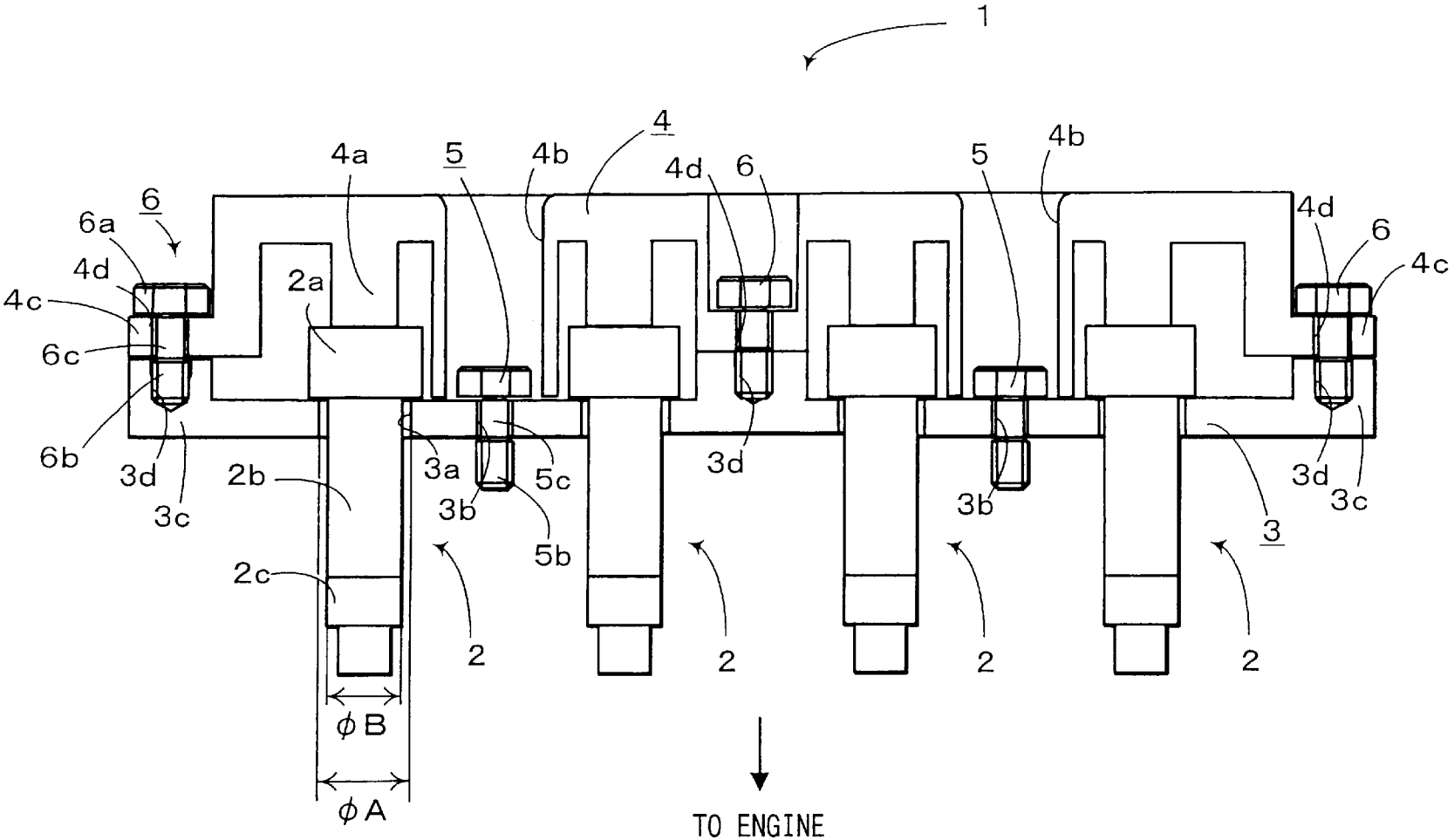
FIG. 1 is a schematic side view of an ignition coil assembly according to a first embodiment of the present invention.

That is, as shown in FIGS. 1 to 4, the ignition coil assembly 1 includes the ignition coils 2, a base cover 3, a top cover 4, two fastening bolts 5 and three connecting bolts 6. The base cover 3 supports the ignition coils 2 at predetermined intervals. The top cover 4 is arranged to cover a top surface of the base cover 3. The fastening bolts 5 serve as fastening members (or fastening screws) that secure only the base cover 3 to the engine 30. The connecting bolts 6 serve as connecting members (or connecting screws) that connect between the base cover 3 and the top cover 4. It should be understood that the ignition coil assembly 1 shown in FIG. 1 is for a four cylinder engine and thus includes four ignition coils 2.

Each ignition coil 2 is formed as a stick shaped component that has a case, which is made of a dielectric resin material and receives an electric circuit for generating high voltage to be supplied to the corresponding spark plug 32. As shown in FIG. 1, each ignition coil 2 includes a head 2*a*, a cylindrical main body 2*b* and a tubular plug cap 2*c*. The head 2*a* is arranged at the top end of the ignition coil 2. The cylindrical main body 2*b* extends downwardly from the head 2*a*. The tubular plug cap 2*c* is connected to the lower end of the main body 2*b*.

The head 2*a* is formed as a generally cubic body. A size of the head 2*a*, i.e., a diameter of the circumcircle, which passes through all vertices of the head 2*a* in a plane that is perpendicular to the axis of the ignition coil 2, is greater than the inner diameter of a corresponding one of the plug holes 31 of the engine 30. A connector (not shown) projects laterally from one side of the head 2*a* of each ignition coil 2. The connector of each ignition coil 2 is connected to a connector of a cord electrically connected to a battery (not shown) to allow supply of electric current to the ignition coil 2.

The cylindrical main body 2*b* has the outer diameter smaller than the size of the head 2*a* and is inserted into the corresponding plug hole 31. Thus, each ignition coil 2 is installed to the base cover 3 such that the main body 2*b* of the ignition coil 2 is inserted through a corresponding one of receiving through holes 3*a* of the base cover 3, and the head 2*a* is placed over the top surface of the base cover 3 around the corresponding one of the receiving through holes 3*a*.

The tubular plug cap 2*c* is formed as a tubular body made of a resilient material, such as a rubber material. When the ignition coil 2 is inserted into the corresponding plug hole 31, an inner peripheral surface of the plug cap 2*c* of the ignition coil 2 receives a top end of the corresponding spark plug 32 such that the ignition coil 2 and the spark plug 32 are connected to each other. Each of the plug cap 2*c* and the main body 2*b* has a corresponding internal engaging structure that allows secure engagement between the plug cap 2*c* and the main body 2*b* at the inside thereof. The plug cap 2*c* and the main body 2*b* are securely engaged with each other in a manner that prevents disengagement of the plug cap 2*c* from the main body 2*b* even when the plug cap 2*c* is axially pulled in a direction away from the main body 2*b*.

The base cover 3 is an elongated plate like body made of, for example, a dielectric resin material. The receiving through holes 3*a* of the base cover 3 are arranged at corresponding positions that correspond to positions of the plug holes 31 of the engine 30 and receive the main body 2*b* of the corresponding ignition coil 2. The inner diameter $\phi A$ of each receiving through hole 3*a* is greater than the outer diameter $\phi B$ of the corresponding main body 2*b* such that the main body 2*b* is loosely received through the receiving through hole 3*a*. Thus, when the main body 2*b* is received through the receiving through hole 3*a*, there is provided play (or a gap), which corresponds to $\phi A-\phi B$. As a result, each ignition coil 2 can slide within the range of $\phi A-\phi B$ in an imaginary plane that is perpendicular to the axis of the ignition coil 2. It is desirable that the amount of ($\phi A-\phi B$ is kept within the tolerance of the corresponding plug hole pitches (intervals of the plug holes).

Two base cover through holes 3*b* are provided in the base cover 3. One of the base cover through holes 3*b* is positioned between one of the opposed longitudinal ends of the base cover 3 and the center of the base cover 3, and the other one of the base cover through holes 3*b* is positioned between the other one of the opposed longitudinal ends of the base cover 3 and the center of the base cover 3. The positions of the base cover through holes 3*b* correspond to positions of threaded screw holes 33 of the engine 30. Female threads, which are threadably engageable with male threads of a male threaded portion 5*b* of the corresponding fastening bolt 5, are formed along an inner peripheral surface of each base cover through hole 3*b*.

Flanges 3c are provided at the longitudinal ends of the base cover 3, and three screw holes 3*d* for threadably engaging with the connecting bolts 6 are provided in the flanges 3*c* and the center of the base cover 3.

Similar to the base cover 3, the top cover 4 is an elongated plate like body made of, for example, a dielectric resin material. A plurality of coil stop protrusions 4*a* is provided in a lower surface of the top cover 4 to protrude downward. The positions of the coil stop protrusions 4*a* correspond to the positions of the ignition coils 2.

Two accommodating through holes 4*b* are provided in the top cover 4. One of the through holes 4*b* is positioned between one of the opposed longitudinal ends of the top cover 4 and the center of the top cover 4, and the other one of the through holes 4*b* is positioned between the other one of the opposed longitudinal ends of the top cover 4 and the center of the top cover 4. The inner diameter of each through hole 4*b* is larger than a size of a head 5*a* of the corresponding fastening bolt 5, i.e., an diameter of the circumcircle, which passes through all vertices of the head 5*a* in a plane that is perpendicular to the axis of the bolt 5. Thus, the head 5*a* of each bolt 5 is exposed outside the corresponding through hole 4*b*. As a result, tightening and loosing of each bolt 5 can be relatively easily performed while the top cover 4 is secured to the base cover 3.

Flanges 4*c* are provided at the longitudinal ends of the top cover 4, and three top cover through holes 4*d* are provided in the flanges 4*c* and the center of the top cover 4. The top cover through holes 4*d* are formed coaxially with the corresponding screw holes 3*d*. Female threads, which are threadably engageable with male threads of a male threaded portion 6*b* of the corresponding connecting bolt 6, are formed along an inner peripheral surface of each top cover through hole 4*d*.

Each fastening bolt 5 is formed as a hexagonal bolt and includes the head 5*a*, the male threaded portion 5*b* and an underhead portion 5*c*. The head 5*a* is provided at a proximal end of the bolt 5. The male threaded portion 5*b* is provided at a distal end of the bolt 5 and is provided with the male threads, which are threadably engageable with the female threads of the corresponding base cover through hole 3*b*. The underhead portion 5*c* is provided between the head 5*a* and the male threaded portion 5*b* and has an unthreaded smooth outer surface.

Each connecting bolt 6 is formed as a hexagonal bolt and includes a head 6*a*, the male threaded portion 6*b* and an underhead portion 6*c*. The head 6*a* is provided at a proximal end of the connecting bolt 6. The male threaded portion 6*b* is provided at a distal end of the connecting bolt 6 and has the male threads, which are threadably engageable with the female threads of the corresponding top cover through hole 4*c*. The underhead portion 6*c* is provided between the head 6*a* and the male threaded portion 6*b* and has an unthreaded smooth outer surface.

The top cover 4 is installed such that the top cover 4 covers the base cover 3. Furthermore, each connecting bolt 6 is received through the corresponding top cover through hole 4*d*, and the male threaded portion 6*b* of the connecting bolt 6 is threadably engaged with the female threads of the corresponding screw hole 3*d* of the base cover 3. In this way, the top cover 4 and the base cover 3 are connected to each other.

Furthermore, after the top cover 4 and the base cover 3 are connected together by the connecting bolts 6, each fastening bolt 5 is received through the corresponding base cover through hole 3*b*, and the male threaded portion 5*b* at the distal end of the fastening bolt 5 is threadably engaged with the female threads of the corresponding screw hole 33 of the engine 30. In this way, only the base cover 3 is directly secured to the engine 30.

Installation procedure of the ignition coil assembly 1 into the engine 30 will be described with reference to FIGS. 1 to 3.

Figure 2:
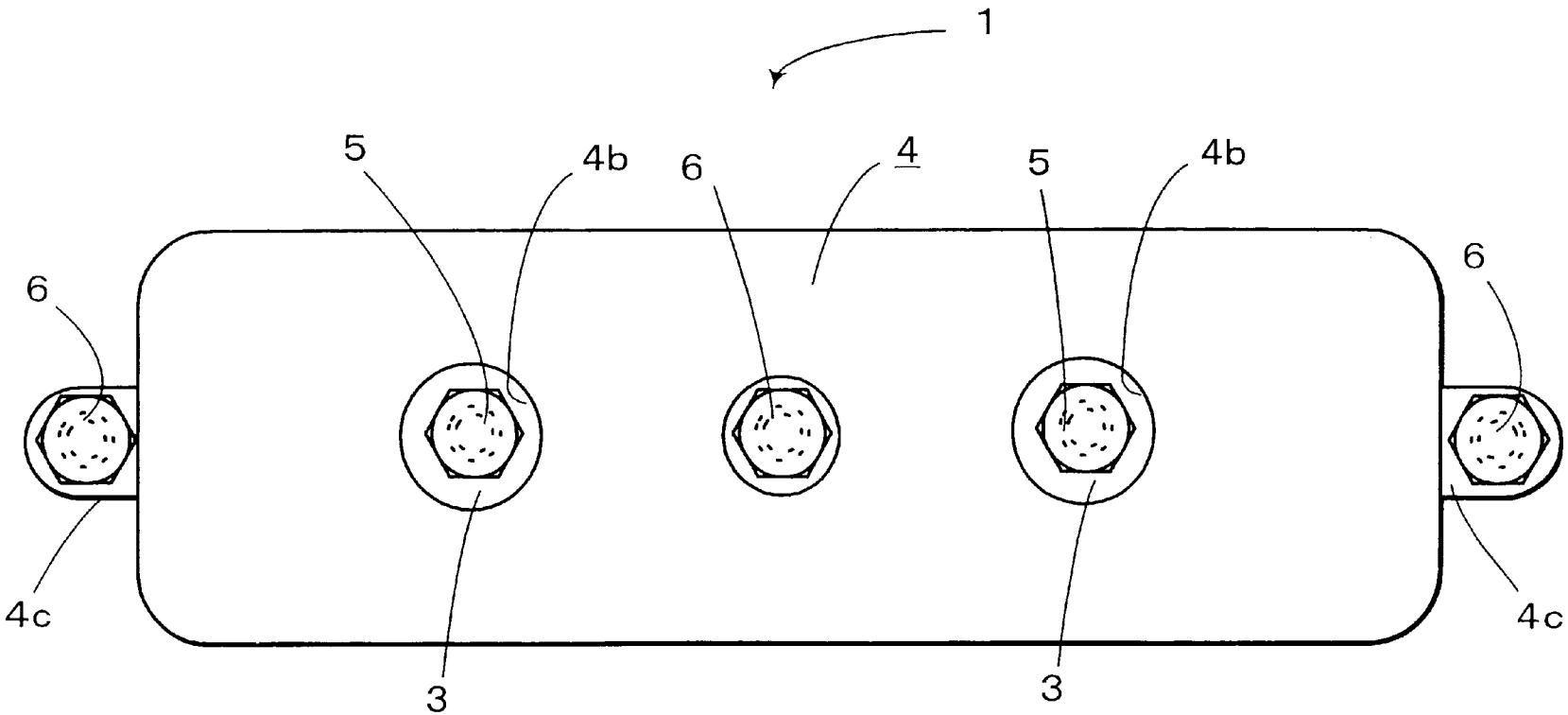
FIG. 2 is a plan view of the ignition coil assembly of the first embodiment.
Figure 3:
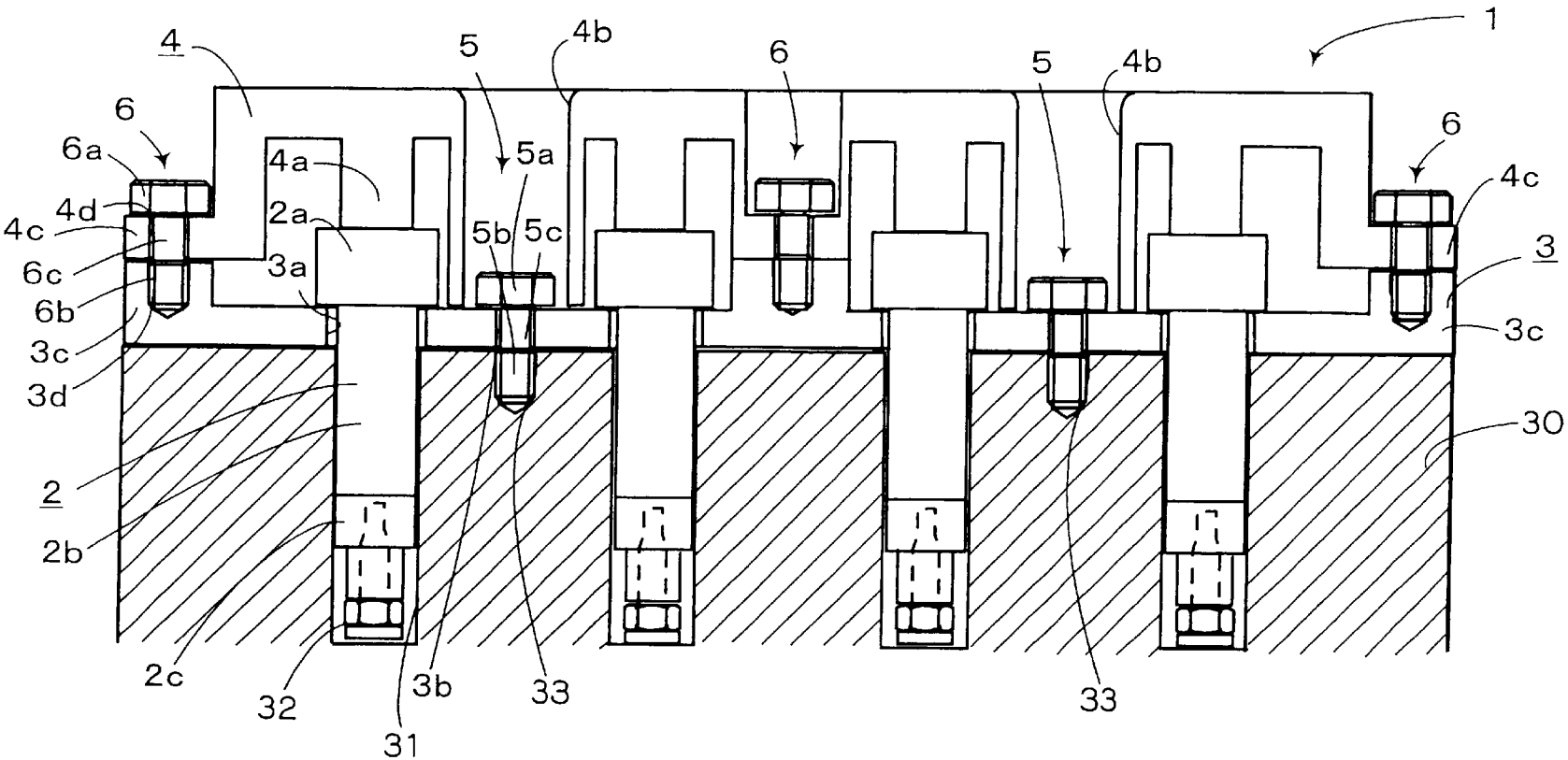
FIG. 3 is a schematic side view showing a state after installation of the ignition coil assembly of the first embodiment into an engine.
Figure 4:
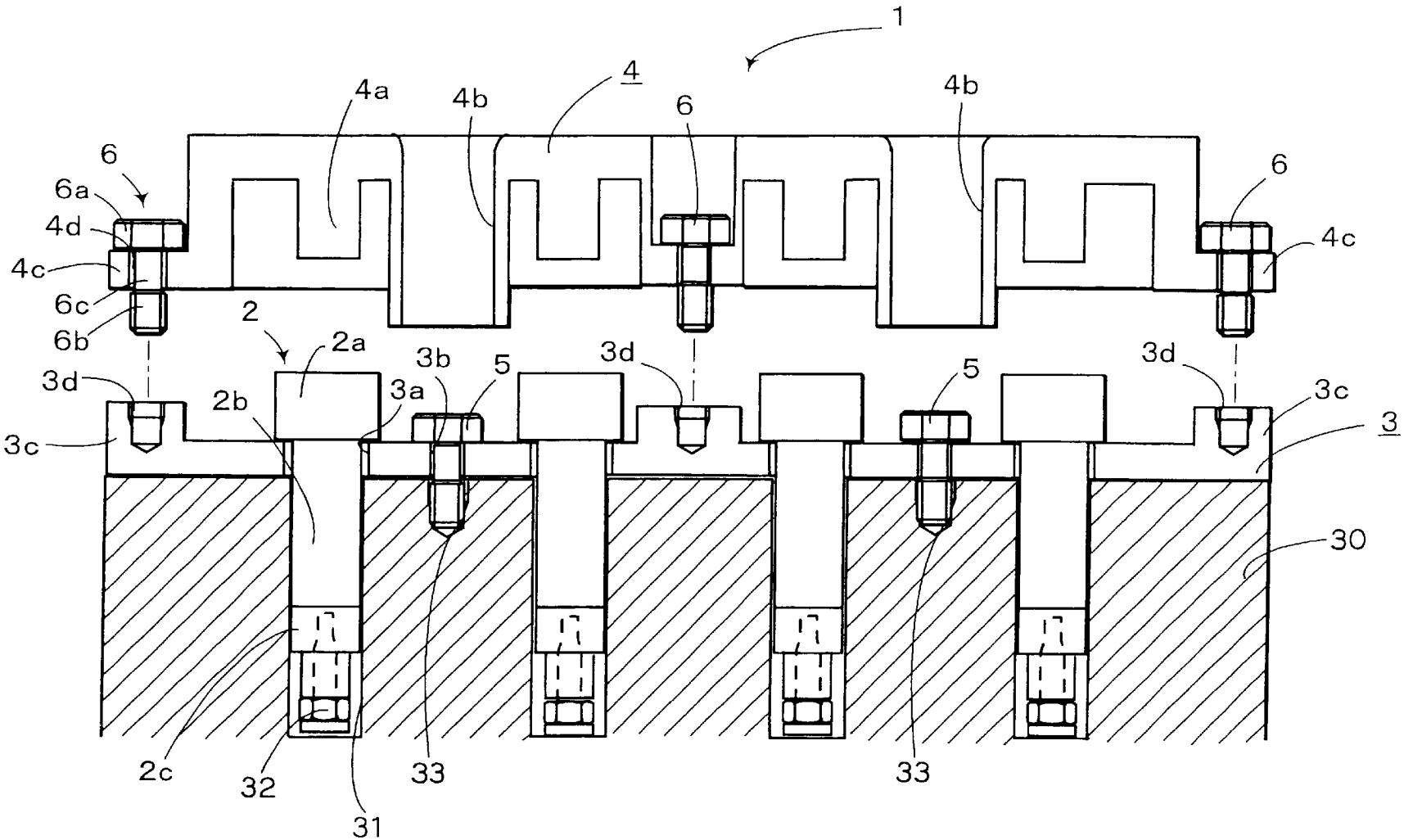
FIG. 4 is a schematic side view showing a state after removal of a top cover of the ignition coil assembly of the first embodiment.
Figure 5A:
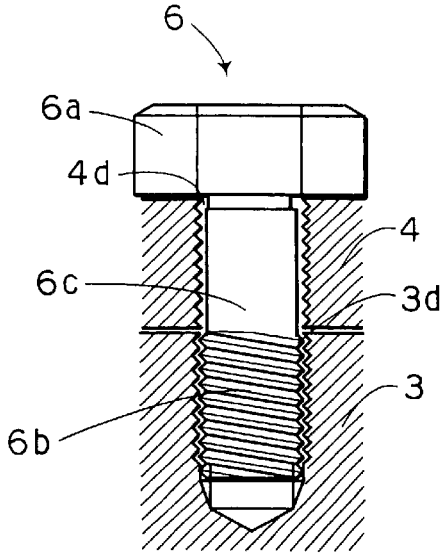
FIG. 5A is a schematic view showing a connecting bolt installed into the top cover and a base cover of the ignition coil assembly of the first embodiment.
Figure 5B:
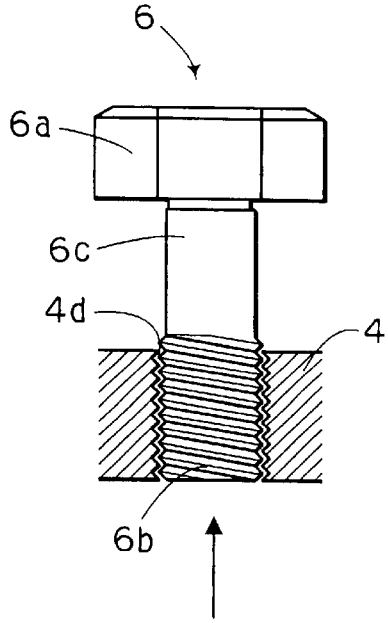
FIG. 5B is a schematic view showing a partially removed state of the connecting bolt of the first embodiment.

First, as shown in FIGS. 1 and 2, after the top cover 4 and the base cover 3 are connected together by the connecting bolts 6, the ignition coil assembly 1 is placed over the engine 30 such that the ignition coils 2 are aligned with the plug holes 31 of the engine 30.

Then, the ignition coil assembly 1 is lowered such that each ignition coil 2 is axially inserted into the corresponding plug hole 31, and the base cover 3 is placed on the top surface of the engine 30. Furthermore, the top surface of the top cover 4 is urged downward, so that the inner peripheral surface of the plug cap 2*c* of each ignition coil 2 is engaged with the top end of the corresponding spark plug 32. In this way, the ignition coil 2 and the spark-plug 32 are connected to each other. Even if manufacturing error in the plug hole pitches of the plug holes 31 occurs, each ignition coil 2 can be easily and reliably secured to the corresponding plug hole 31 in the following manner. That is, as described above, the main body 2*b* of each ignition coil 2 is loosely received in the corresponding receiving through hole 3*a* of the base cover 3, and the top cover 4 and the base cover 3 are temporarily fastened to the engine 30 by the fastening bolts 5, so that each ignition coil 2 can be inserted into the corresponding plug hole 31 and can abut against the inner peripheral surface of the corresponding plug hole 31 to achieve slide adjustment of the position of each ignition coil 2 in the plane that is perpendicular to the axis of the ignition coil 2. Each coil stop protrusion 4*a* located in the lower surface of the top cover 4 is downwardly pressed against the head 2*a* of the corresponding ignition coil 2 to secure the same.

Thereafter, each fastening bolt 5, which is exposed in the corresponding top cover through hole 4*b* is rotated clockwise (i.e., rotated in the tightening direction) with a known bolt tightening tool, so that the male threaded portion 5*b* of the fastening bolt 5 is threaded into the corresponding screw hole 33 of the engine 30, and thereby the top cover 4 is secured to the engine 30 together with the base cover 3.

Finally, the connector of each ignition coil 2 located at the back side of the head 2*a* is connected to the corresponding connector of the cord connected to the battery (not shown). In this way, installation of the ignition coil assembly 1 is completed.

Next, the procedure for replacing one or more ignition coils 2 after completion of the installation of the ignition coil assembly 1 into the engine 30 will be described.

First, each connecting bolt 6 is rotated counterclockwise (i.e., rotated in the loosening direction) to loosen the connecting bolt 6, so that the engagement between the top cover 4 and the base cover 3 is released. Next, the top cover 4 is lifted, and thus the top cover 4 is removed from the base cover 3 (see FIG. 4). At this stage, when each connecting bolt 6 is further rotated counterclockwise, the male threaded portion 6*b* is threadably engaged with the female threads of the corresponding top cover through hole 4*d*, so that detachment of the connecting bolt 6 from the top cover 4 is advantageously limited (see FIG. 5). The base cover 3 is kept secured to the engine 30 by the fastening bolts 5. Furthermore, since each ignition coil 2 is connected to the corresponding spark plug 32 through the plug cap 2*c*, the head 2*a* of each ignition coil 2 is remained on the top surface of the base cover 3 around the corresponding receiving through hole 3*a*.

Thereafter, the ignition coil(s) 2, which requires replacement, examination or the like, is removed from the corresponding plug hole(s) 31. After completion of the corresponding work, such as the replacement of the corresponding ignition coil 2, the top cover 4 is placed over the base cover 3 to cover the base cover 3. Then, each connecting bolt 6 is aligned with the corresponding base cover screw hole 3*d* and is rotated clockwise (i.e., rotated in the tightening direction) by the known bolt tightening tool, so that each connection bolt 6 is threaded into the corresponding base cover screw hole 3*d*. In this way, the top cover 4 is connected to the base cover 3.

Upon completion of the above procedure, the work, such as the replacement of the corresponding ignition coil 2, is completed.

At the time of removing the entire ignition coil assembly 1 from the engine 30, the following procedure is performed. First, each fastening bolt 5 is rotated counterclockwise (i.e., rotated in the loosening direction) with use of the known bolt removing tool to loosen each fastening bolt 5. Then, the base cover 3 is lifted away from the engine 30 to integrally remove the base cover 3 and the top cover 4, which are connected together by the connecting bolts 6. At this time, since the head 2*a* of each ignition coil 2 is placed on the top surface of the base cover 3 around the corresponding receiving through hole 3*a*, each ignition coil 2 is removed together with the base cover 3 and the top cover 4 from the engine 30. Furthermore, as described above, the female threads are formed in each base cover through hole 3*b*, so that when the base cover 3 is removed from the engine 30, the male threaded portion 5*b* of each fastening bolt 5 is threadably engaged with the female threads of the corresponding base cover through hole 3*b*. Thus, detachment of each fastening bolt 5 from the base cover 3 is limited (this is achieved with the structure similar to the structure of the connecting bolt 6 shown in FIG. 5).

The ignition coils 2 are integrated by the base cover 3 and the top cover 4 and are arranged at the intervals, which correspond to the intervals of the plug holes 31 of the engine 30, in such a manner that each ignition coil 2 is oriented in the axial direction of the corresponding plug hole 31. Thus, the ignition coils 2 can be installed into the engine 30 at once in a single step. As a result, an installation time period required to install the ignition coils 2 is reduced in comparison to the case where the ignition coils 2 are installed one by one.

Furthermore, at the time of replacing one or more ignition coils 2, it is possible to remove only the top cover 4 while the base cover 3 is kept secured to the engine 30. Thus, the corresponding ignition coil 2, which requires examination or replacement, can be easily removed. Also, it is not required to reposition the base cover 3 and each ignition coil 2 relative to the engine 30 to install them to the engine 30. Thus, the corresponding work, such as replacement of the corresponding ignition coil 2, can be simply and quickly performed.

Even when the manufacturing error in the plug hole pitches occur, each ignition coil 2 can be easily and reliably installed into the corresponding plug hole 31 because of the structure that allows positioning of each ignition coil 2 relative to the top cover 4 and the base cover 3 in the plane that is perpendicular to the axis of the ignition coil 2.

(Second Embodiment)

A second embodiment of the present invention will be described with reference to FIGS. 6 to 8. The components similar to those discussed with reference to the first embodiment will be indicated by the same numerals and will not be described for the sake of simplicity.

In the second embodiment, at the time of installation to the engine 30, the top cover 4 and the base cover 3 are integrally secured to the engine 30 by bolts used to connect the top cover 4 and the base cover 3 together.

Figure 6:
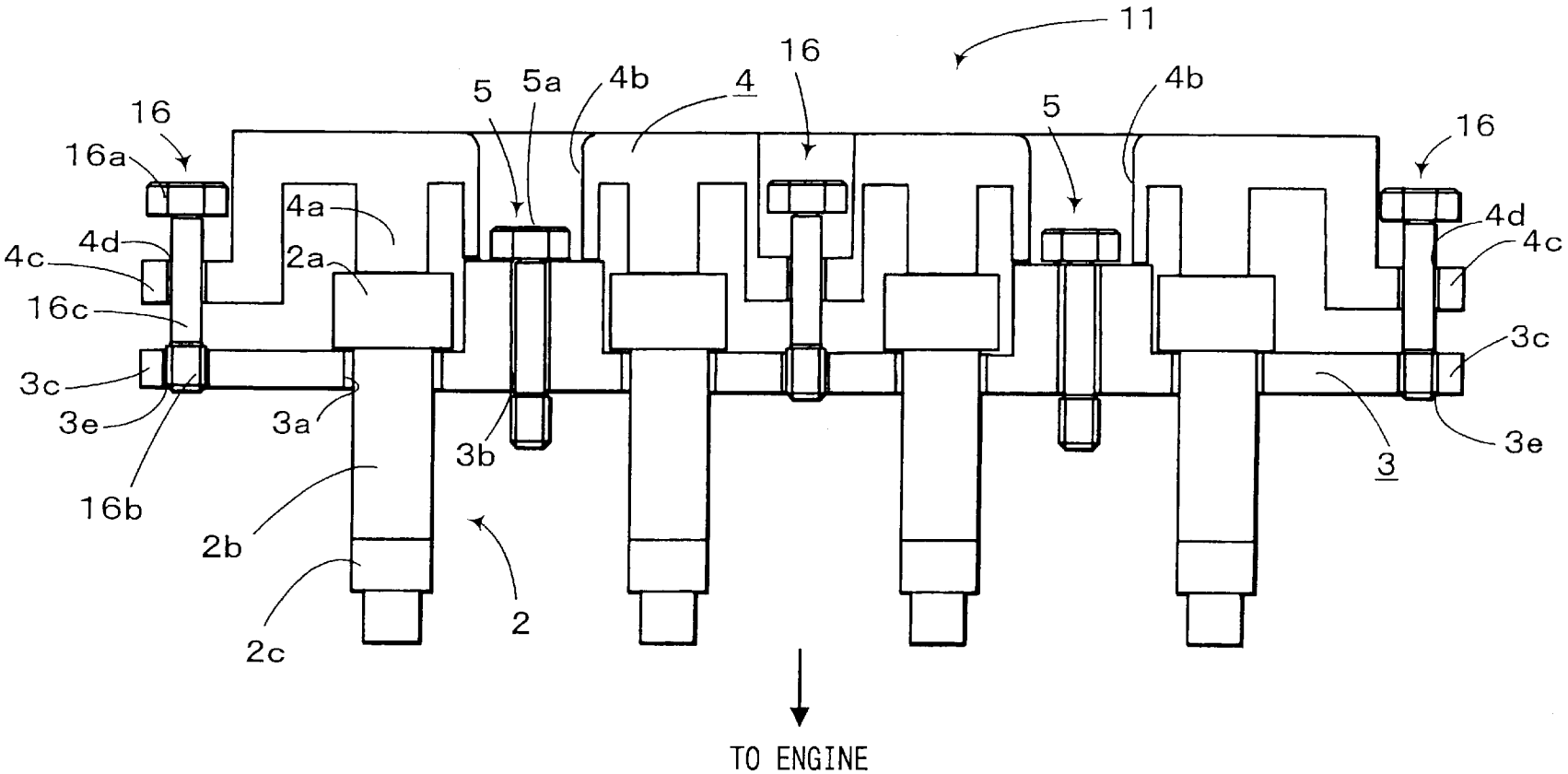
FIG. 6 is a schematic side view of an ignition coil assembly according to a second embodiment of the present invention.

That is, as shown in FIG. 6, in the base cover 3 of an ignition coil assembly 11 of the second embodiment, three base cover through holes 3*e* are provided in place of the screw holes 3*d* of the first embodiment, and female threads are formed in an inner peripheral surface of each base cover through hole 3*e*. Furthermore, three threaded screw holes 34 are formed in the engine 30 at positions, which correspond to the positions of the base cover through holes 3*e*.

Before installation of the ignition coil assembly 11 into the engine 30, three connecting bolts 16 are received through the top cover through holes 4*d*, respectively, and a male threaded portion 16*b* of each connecting bolt 16 is threadably engaged with the female threads of the correspondinig base cover through hole 3*e*. In this way, the top cover 4 and the base cover 3 are connected together, as shown in FIG. 6.

Figure 7:
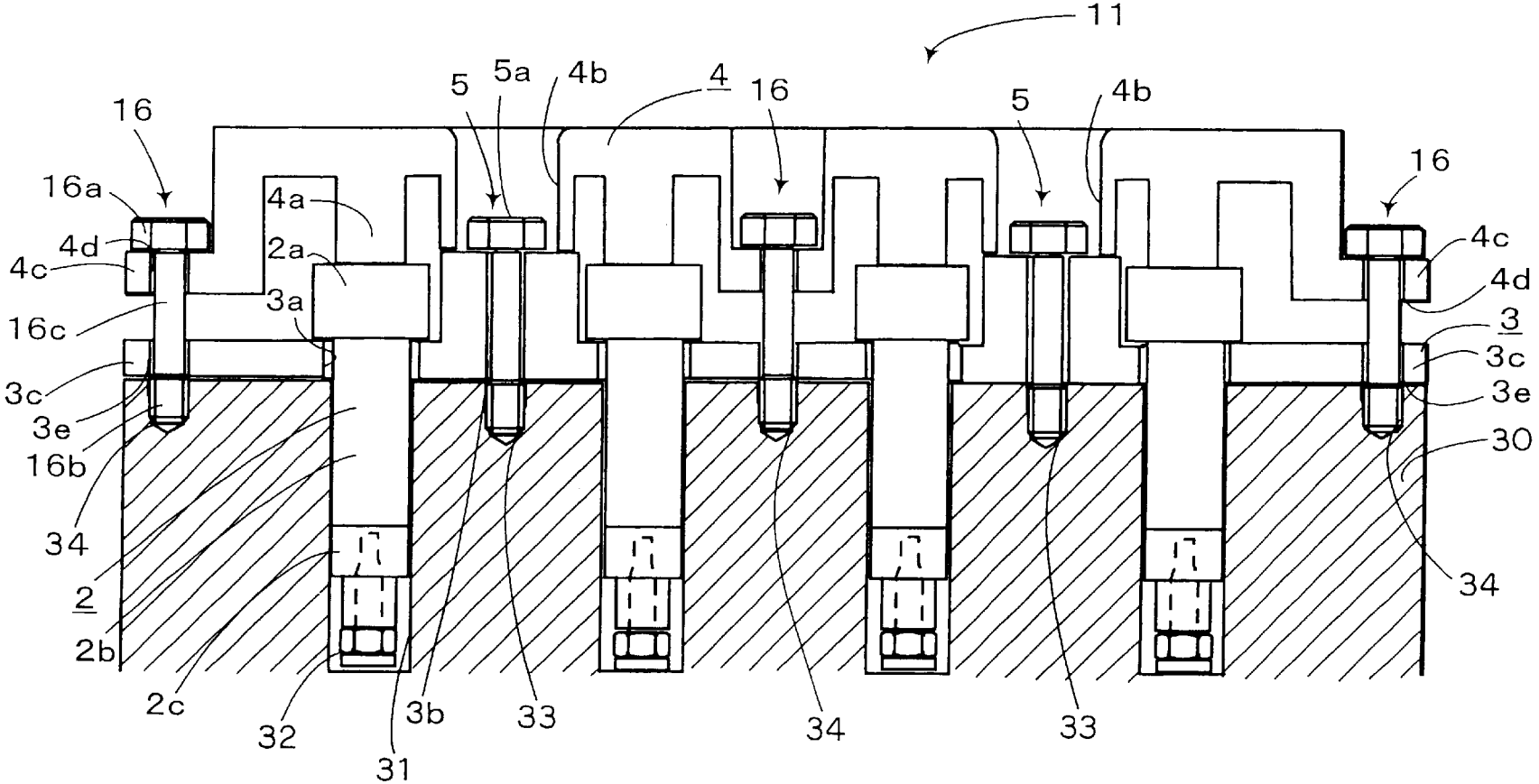
FIG. 7 is a schematic side view showing a partially installed state of the ignition coil assembly of the second embodiment.

Then, as shown in FIG. 7, each base cover through hole 3*e* of the base cover 3 is aligned with the corresponding screw hole 34 of the engine 30, and the base cover 3 is placed on the top surface of the engine 30. Then, each connecting bolt 16 is rotated clockwise (i.e., rotated in the tightening direction), so that each connecting bolt 16 is threaded into the screw hole 34 of the engine 30. Thus, the base cover 3 is secured to the engine 30 with the connecting bolts 5, and, at the same tine, the top cover 4 and the base cover 3 are integrally secured to the engine 30 by the connecting bolts 16. As a result, the ignition coil assembly 11 is more tightly secured to the engine 30 in comparison to the ignition coil assembly 1 of the first embodiment.

Figure 8A:
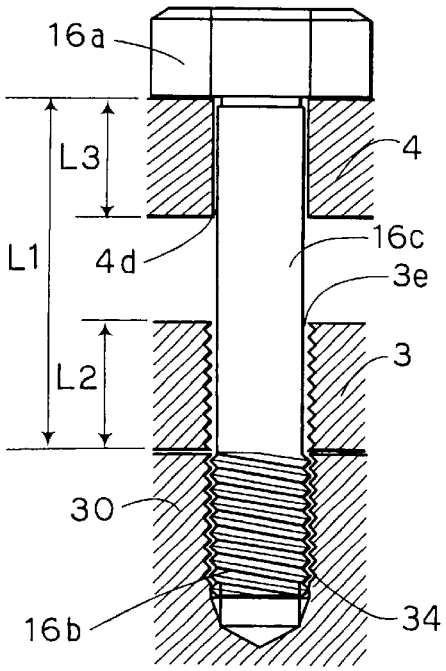
FIG. 8A is a schematic view showing a connecting bolt installed into a through hole of a top cover and a through hole of a base cover of the ignition coil assembly of the second embodiment and is threadably engaged with a threaded screw of the engine.
Figure 8B:
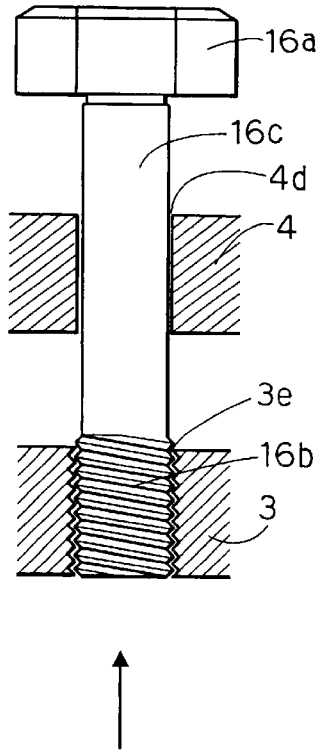
FIG. 8B is a schematic view showing a state where the connecting bolt of the second embodiment is threadably engaged with the through hole of the base cover.
Figure 8C:
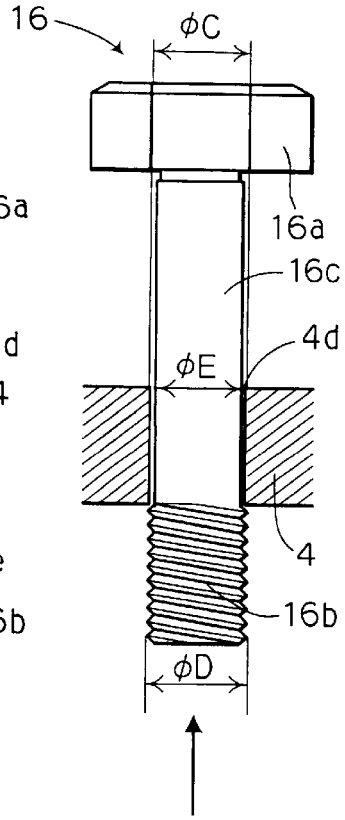
FIG. 8C is a schematic view showing a state where the connecting bolt of the second embodiment is engaged with an peripheral edge of the through hole of the top cover.

Next, a detachment preventing structure for preventing detachment of each connecting bolt 16 from the ignition coil assembly 11 will be described with reference to FIGS. 8A–8C. FIG. 8A shows a state where each connecting bolt 16 is threadably engaged with the corresponding screw 34 of the engine 30, so that the top cover 4 and the base cover 3 are integrally secured to the engine 30. FIG. 8B shows a state where each connecting bolt 16 is threadably engaged with the corresponding base cover through hole 3*e* to connect between the top cover 4 and the base cover 3. FIG. 8C shows a state where the upper end of the male threaded portion 16*b* of each connecting bolt 16 is engaged with the lower end peripheral edge of the top cover through hole 4*d*.

As shown in FIGS. 8A–8C, the male threaded portion 16*b* and the underhead portion 16*c* of the connecting bolt 16 are formed to satisfy the following relationship:

$$\phi E<\phi C<\phi D$$

where $\phi E$ is the outer diameter of the underhead portion 16*c*, $\phi C$ is the inner diameter of the top cover through hole 4*d*, and $\phi D$ is the outer diameter of the male threaded portion 16*b*. The axial length L1 of the underhead portion 16*c* is selected to be longer than the sum of the length L2 of the base cover through hole 3*e* and the length L3 of the top cover through hole 4*d*.

As mentioned above, the outer diameter $\phi D$ of the male threaded portion 16*b* is larger than the inner diameter $\phi C$ of the top cover through hole 4*d*, so that the upper end of the male threaded portion 16*b* of the connecting bolt 16 engages the lower end peripheral edge of the top cover through hole 4*d* to prevent detachment of the connecting bolt 16.

Each fastening bolt 5 can have the structure similar to the above described detachment preventing structure of the connecting bolt 16 if it is appropriate.

(Third Embodiment)

Figure 9:
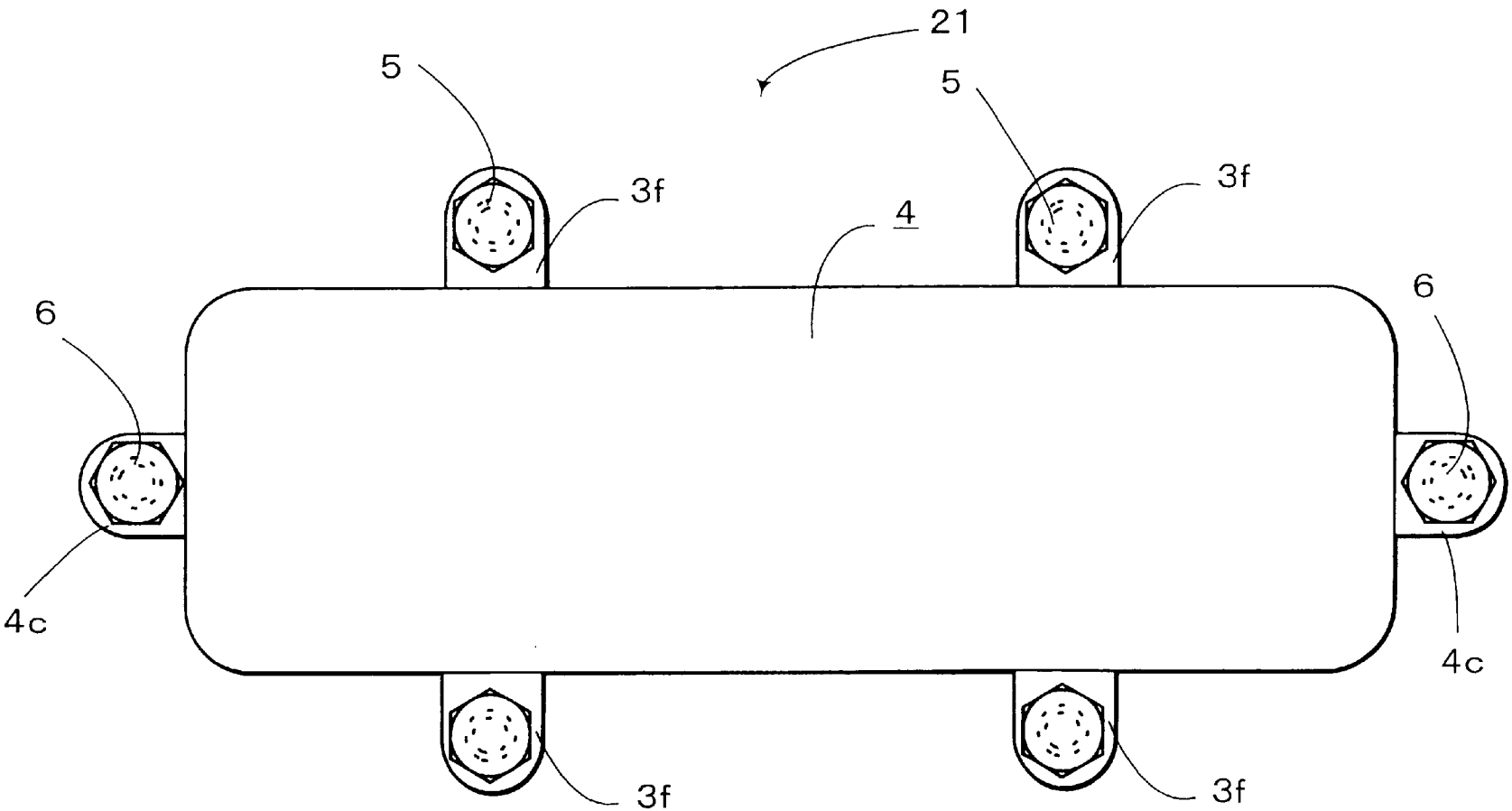
FIG. 9 is a plan view of an ignition coil assembly according to a third embodiment of the present invention.

A third embodiment of the present invention will be described with reference to FIG. 9.

An ignition coil assembly 21 of the third embodiment is constructed to be secured to the engine 30 at the outer periphery of the base cover 3.

That is, the base cover 3 of the ignition coil assembly 21 has four flanges 3*f*. Two of the flanges 3*f* project laterally outwardly from one lateral side of the base cover 3, and the other two of flanges 3*f* project laterally outwardly from the other lateral side of the base cover 3. Each flange 3*f* has a base cover through hole 3*b*, which penetrates through the flange 3*f* and receives a corresponding fastening bolt 5 in a manner similar to the first embodiment The fastening bolt 5 is received through the base cover through hole 3*b* of the corresponding flange 3*f* and is threadably engaged with a corresponding screw hole 33 of the engine 30 to secure only the base cover 3 to the engine 30.

In the present embodiment, the fastening bolts 5 are provided around the outer peripheral of the base cover 3, so that there is no need to provide the accommodating through holes 4*d* in the top cover 4 to expose the corresponding fastening bolts 5 secured to the base cover 3, as in the case of the first embodiment.

(Fourth Embodiment)

A fourth embodiment of the present invention will be described with reference to FIGS. 10A and 10B.

An ignition coil assembly 31 of the fourth embodiment is constructed to be secured to the engine 30 by securing the base cover to the engine 30 through use of spring members 35 without using the fastening bolts.

Figure 10A:
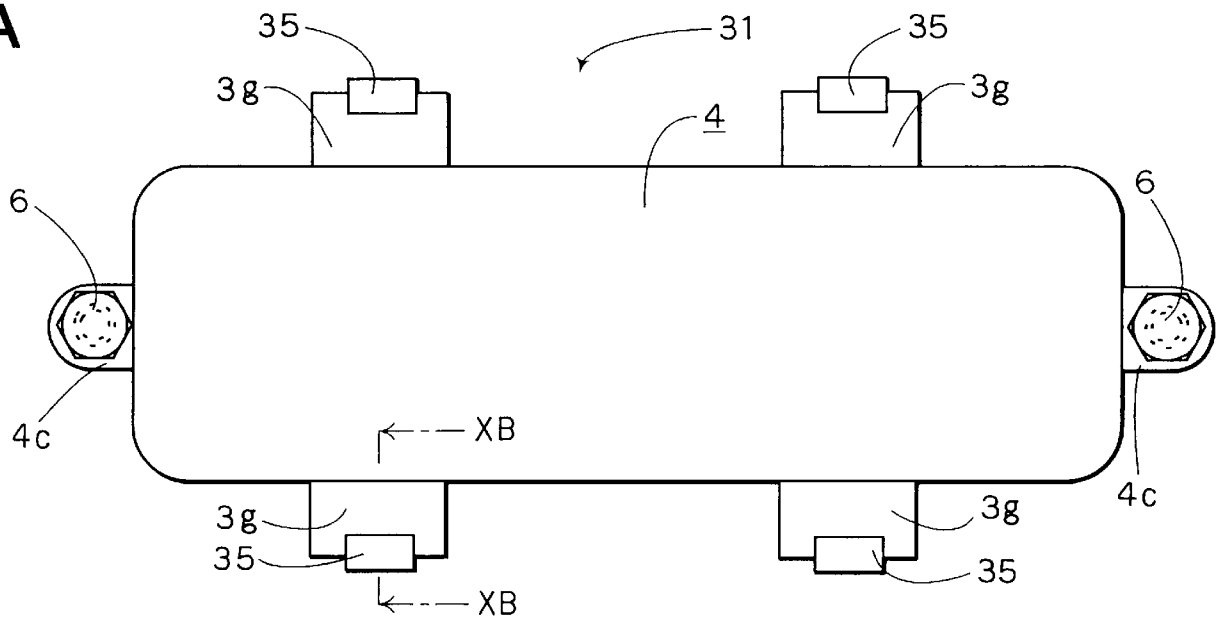
FIG. 10A is a plan view of an ignition coil assembly according to a fourth embodiment of the present invention.
Figure 10B:
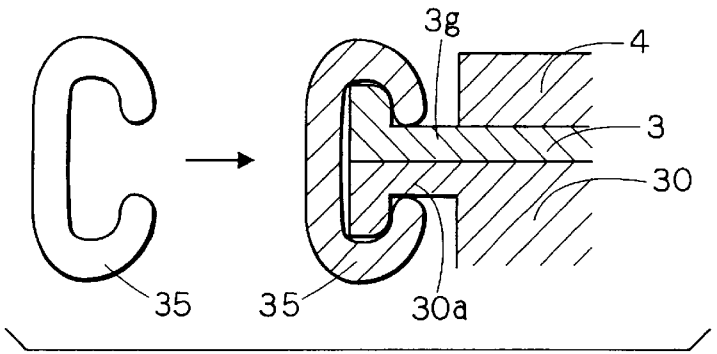
FIG. 10B is a cross sectional view along line XB—XB in FIG. 10A.

That is, as shown in FIGS. 10A and 10B, the top surface of the engine 30 is provide with flanges (or protrusions) 30*a*, and the base cover 3 of the ignition coil assembly 31 has flanges 3*g* at positions that correspond to the positions of the flanges 30*a* of the engine 30. A distal end of each flange 30*a* of the engine 30 projects downward, and a distal end of each flange 3*g* of the base cover 3 projects upward, as shown in FIG. 10B.

A mouth of each spring member 35 made of a C-shaped plate spring is press fitted against the corresponding flange 30*a* of the engine 30 and the corresponding flange 3*g* of the base cover 3, so that the distal end of the flange 30*a* of the engine 30 and the distal end of the flange 3*g* of the base cover 3 are connected together by the spring member 35. In this way, only the base cover 3 is urged against and is secured to the engine 30. Furthermore, by removing each spring member 35 from the corresponding flange 30*a* of the engine 30 and the corresponding flange 3*g* of the base cover 3, the base cover 3 can be released from the engine 30.

It should be noted that the present invention is not limited to the above embodiments, and the above embodiments can be modified in any appropriate manner without departing from the scope of the invention.

Figure 11:
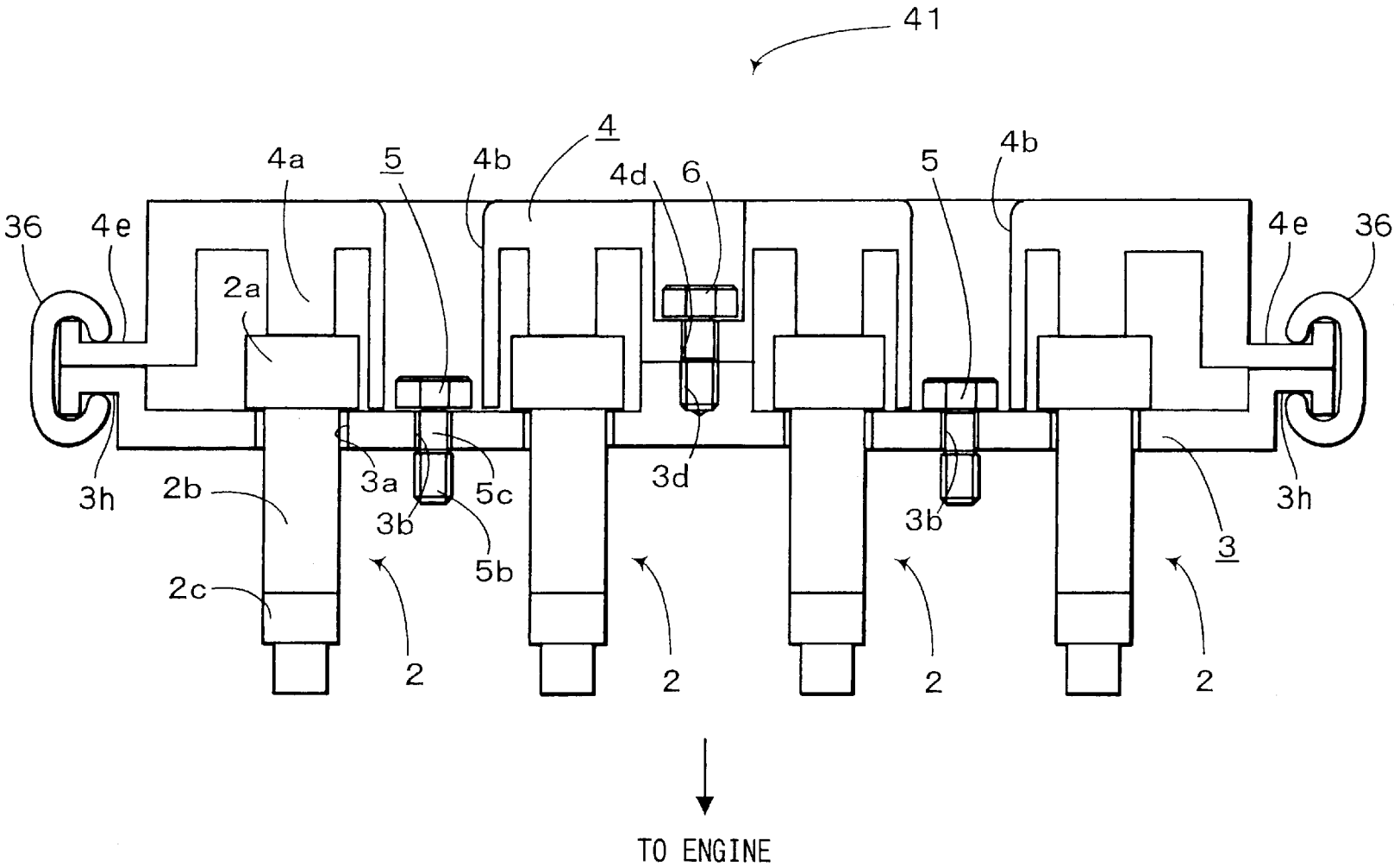
FIG. 11 is a schematic side view showing a modification of the ignition coil assembly.
Figure 12:
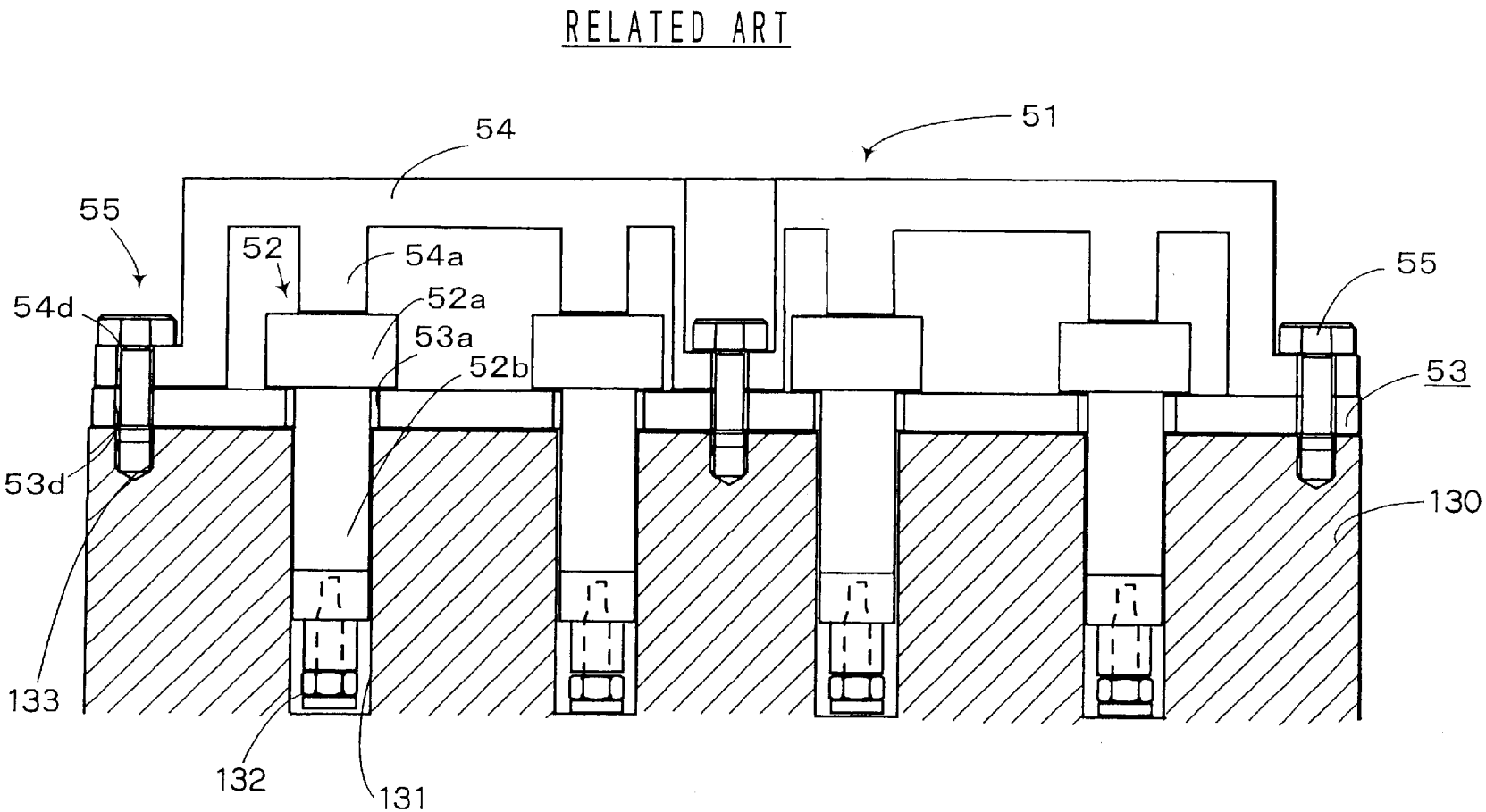
FIG. 12 is a schematic side view of a previously proposed ignition coil assembly.
Figure 13:
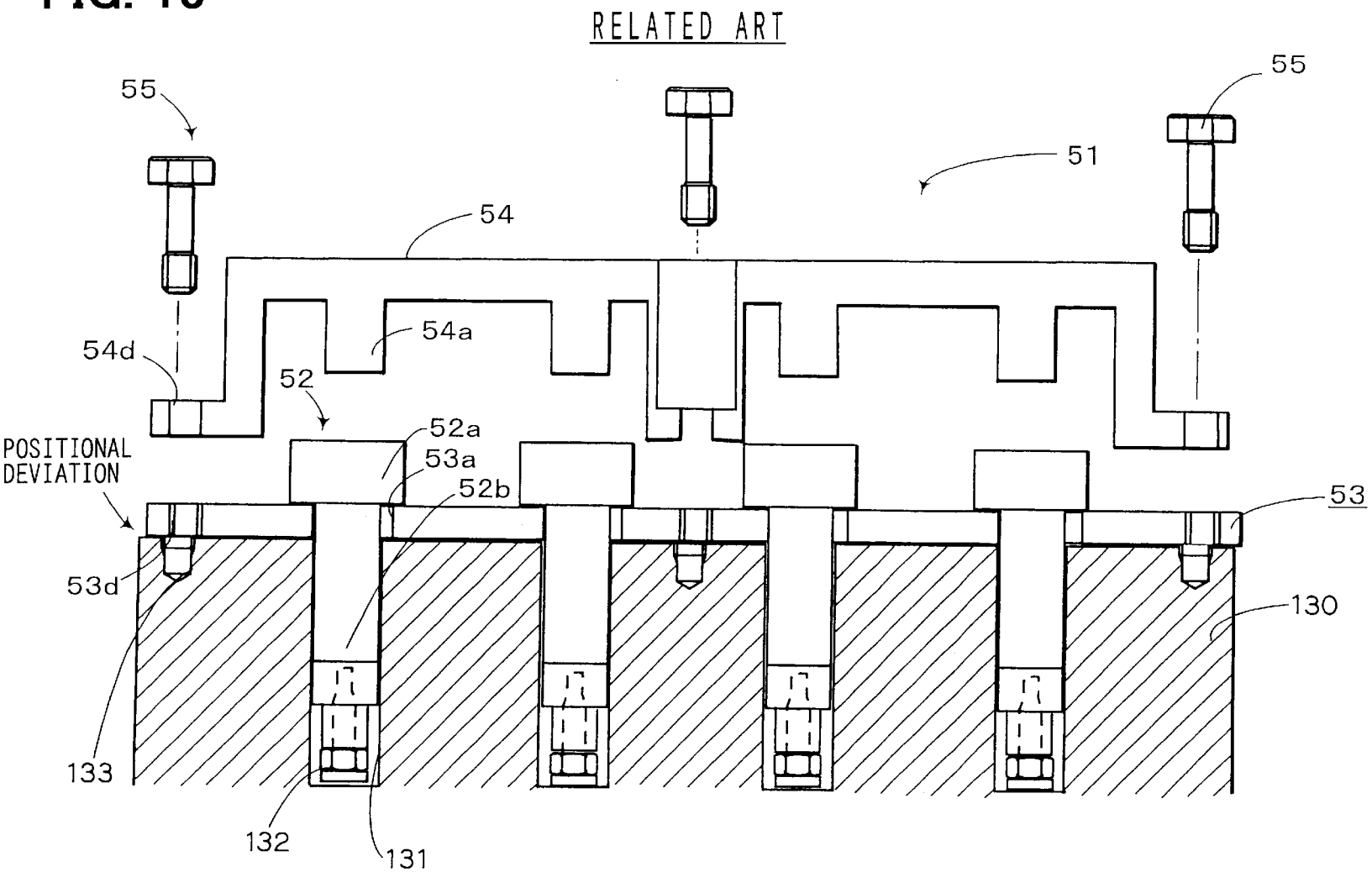
FIG. 13 is a schematic side view showing a state after removal of a top cover and fastening bolts of the previously proposed ignition coil assembly.

For example, in the fourth embodiment, the base cover 3 is secured to the engine 30 by the spring members 35. Alternatively, as shown in FIG. 11, in an ignition coil assembly 41, which is a modification of the ignition coil assembly 1 of the first embodiment, the base cover 3 and the top cover 4 can be connected together by two spring members 36, each of which is made of a C-shaped plate spring and urges the base cover 3 and the top cover 4 toward each other. Each spring member 36 is similar to the spring members 35 shown in FIGS. 10A and 10B and is engaged with the base cover 3 and the top cover 4 in a manner similar to that of the spring member 35 discussed above. That is, the base cover 3 has two flanges 3*h* at the longitudinal ends of the base cover 3, and a distal end of each flange 3*h* projects downward. The top cover 4 has two flanges 4*e* at the longitudinal ends of the top cover 4, and a distal end of each flange 4*e* projects upward. A mouth of each spring member 36 is press fitted against the corresponding flange 3*h* of the base cover 3 and the corresponding flange 4*e* of the top cover 4, so that the distal end of the flange 3*h* of the base cover 3 and the distal end of the flange 4*e* of the top cover 4 are connected together by the spring member 36.

In the above embodiments, the fastening bolts 5, the spring members 35 and the connecting bolts 6, 16 are depicted for the illustrative purpose. Thus, any known fastening means and/or connecting means can be used in place of them.

Additional advantages and modifications will readily occur to those skilled in the art. The invention in its broader terms is therefore not limited to the specific details, representative apparatus, and illustrative examples shown and described.

What is claimed is:

1. An ignition coil assembly for an engine, wherein the engine includes a plurality of plug holes, each of which receives a corresponding one of a plurality of spark plugs, the ignition coil assembly comprising:

a plurality of ignition coils that are arranged to be electrically connected to the spark plugs, respectively;

a base cover that supports the ignition coils at corresponding positions, which correspond to positions of the plug holes, respectively;

a top cover that covers a top surface of the base cover;

a connecting member that connects between the top cover and the base cover; and a fastening member that secures only the base cover to the engine.

2. An ignition coil assembly according to claim 1, wherein the connecting member is a connecting screw member that connects between the top cover and the base cover.

3. An ignition coil assembly according to claim 2, wherein the top cover and the base cover are integrally secured to the engine by the connecting screw member.

4. An ignition coil assembly according to claim 2, wherein:

the top cover includes a top cover through hole, which penetrates through the top cover and receives the connecting screw member therethrough, wherein an inner peripheral wall of the top cover through hole includes female threads; and the connecting screw member includes a male threaded portion at a distal end of the connecting screw member, wherein the male threaded portion is threadably engageable with the female threads of the top cover through hole.

5. An ignition coil assembly according to claim 2, wherein:

the top cover includes a top cover through hole, which penetrates through the top cover and receives the connecting screw member therethrough;

the connecting screw member includes:

a head that is located at a proximal end of the connecting screw member;

a male threaded portion that is located at a distal end of the connecting screw member; and an underhead portion that is located between the head and the male threaded portion and has an unthreaded smooth outer surface;

a length of the underhead portion is longer than a length of the top cover through hole;

an outer diameter of the underhead portion is smaller than an inner diameter of the top cover through hole; and an outer diameter of the male threaded portion is larger than the inner diameter of the top cover through hole.

6. An ignition coil assembly according to claim 1, wherein the connecting member is a spring member that urges the top cover and the base cover toward each other.

7. An ignition coil assembly according to claim 1, wherein the fastening member is a fastening screw member that secures the base cover to the engine.

8. An ignition coil assembly according to claim 7, wherein:

the base cover includes a base cover through hole, which penetrates through the base cover and receives the fastening screw member therethrough;

the fastening screw member includes:

a head that is located at a proximal end of the fastening screw member;

a male threaded portion that is located at a distal end of the fastening screw member; and an underhead portion that is located between the head and the male threaded portion and has an unthreaded smooth outer surface; and a length of the underhead portion is longer than a length of the base cover through hole;

an outer diameter of the underhead portion is smaller than an inner diameter of the base cover through hole; and an outer diameter of the male threaded portion is larger than the inner diameter of the base cover through hole.

9. An ignition coil assembly according to claim 1, wherein:

the top cover includes an accommodating through hole, which penetrates through the top cover and accommodates the fastening member installed into the base cover; and the accommodating through hole exposes at least a portion of the fastening member.

10. An ignition coil assembly according to claim 1, wherein:

the base cover includes a flange that projects laterally outwardly; and the fastening member is connected to the flange to secure the base cover to the engine.

11. An ignition coil assembly according to claim 1, wherein the fastening member is a spring member that urges the base cover against the engine.

* * * * *